US008112820B2

(12) United States Patent
Johnson et al.

(10) Patent No.: US 8,112,820 B2
(45) Date of Patent: Feb. 14, 2012

(54) INTERFACE SYSTEM FOR GARMENT BARRIER

(75) Inventors: Matthew A. Johnson, Wilmington, DE (US); Mark A. Williams, Landenberg, PA (US)

(73) Assignee: Gore Enterprise Holdings, Inc,, Newark, DE (US)

( * ) Notice: Subject to any disclaimer, the term of this patent is extended or adjusted under 35 U.S.C. 154(b) by 0 days.

(21) Appl. No.: 11/522,489

(22) Filed: Sep. 14, 2006

(65) Prior Publication Data

US 2008/0092280 A1 Apr. 24, 2008

(51) Int. Cl.
*A41D 19/00* (2006.01)

(52) U.S. Cl. ..... 2/160; 2/456; 2/162

(58) Field of Classification Search ..... 2/170, 171, 2/239, 16, 240, 242, 59, 60, 457, 161.4, 161.6, 2/2.17, 160, 162, 2.12, 2.15, 2.14, 910
See application file for complete search history.

(56) References Cited

U.S. PATENT DOCUMENTS

| | | | | |
|---|---|---|---|---|
| 2,813,272 | A | 11/1957 | Hagan | |
| 3,009,164 | A * | 11/1961 | Frey | 2/270 |
| 3,103,016 | A * | 9/1963 | Perlman | 2/270 |
| 3,747,126 | A | 7/1973 | Hoagland | |
| 4,389,734 | A * | 6/1983 | Franz et al. | 2/59 |
| 4,479,268 | A * | 10/1984 | Tillbrook | 2/2.15 |
| 4,856,112 | A * | 8/1989 | Effle | 2/59 |
| 4,924,529 | A | 5/1990 | Grilliot et al. | |
| 5,070,544 | A * | 12/1991 | Aliberti et al. | 2/170 |
| 5,555,561 | A * | 9/1996 | Plachta et al. | 2/457 |
| 5,572,743 | A * | 11/1996 | Yavitz | 2/125 |
| 5,682,616 | A * | 11/1997 | Pisano | 2/239 |
| 6,033,428 | A | 3/2000 | Sardella | 606/213 |
| 6,115,850 | A | 9/2000 | Grilliot et al. | 2/457 |
| 6,523,181 | B2 | 2/2003 | Medves | 2/161.6 |
| 6,576,337 | B1 | 6/2003 | Radford-Hancock | 428/332 |
| 6,715,159 | B2 * | 4/2004 | Cormier | 2/457 |
| 6,941,579 | B2 * | 9/2005 | Tanenbaum | 2/123 |
| 2002/0112272 | A1 | 8/2002 | Culler et al. | 2/161.6 |
| 2002/0178485 | A1 | 12/2002 | Medves | |
| 2003/0046748 | A1 | 3/2003 | Tanenbaum | 2/209.13 |
| 2004/0088780 | A1 | 5/2004 | Bachar | 2/457 |
| 2004/0092852 | A1 | 5/2004 | Kruss | 602/21 |
| 2005/0204451 | A1 | 9/2005 | Plut et al. | 2/161.6 |

FOREIGN PATENT DOCUMENTS

| | | |
|---|---|---|
| DE | 44 23 084 | 1/1996 |
| EP | 00761236 | 3/1997 |
| WO | 2005/039700 | 5/2005 |
| WO | 2006/015395 | 2/2006 |

* cited by examiner

*Primary Examiner* — Katherine Moran
*Assistant Examiner* — Richale Quinn
(74) *Attorney, Agent, or Firm* — Amy L. Miller

(57) ABSTRACT

A protective sealing system with a barrier seal between two articles of apparel is provided. The system has at least two elastomeric cuffs securable to a sealing support oriented between wearer of garment and both the first cuff and the second elastomeric cuff to expand said cuffs providing a double barrier seal.

20 Claims, 8 Drawing Sheets

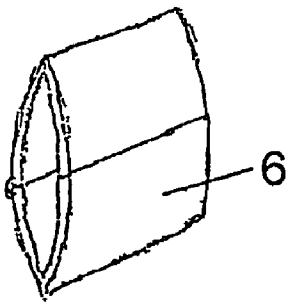
FIG. 6A
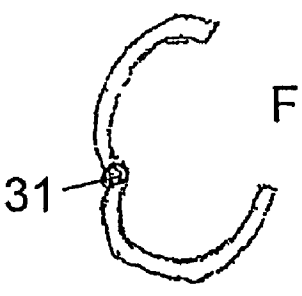
FIG. 6B
FIG. 6C
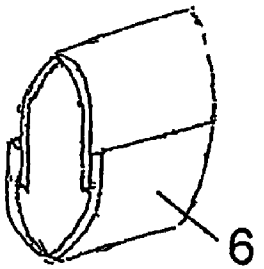
FIG. 6D
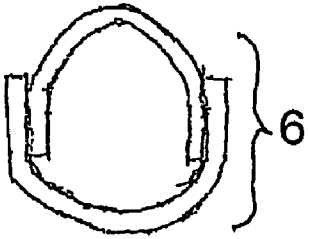
FIG. 6E
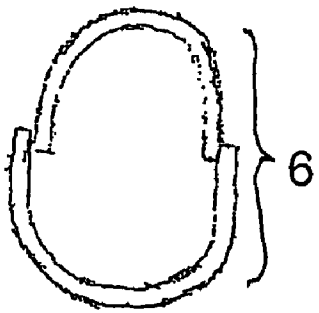
FIG. 6F
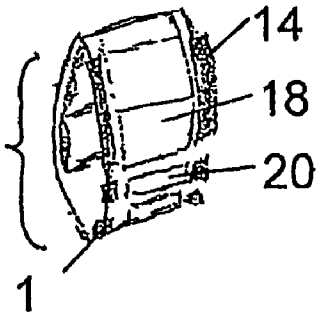
FIG. 6G
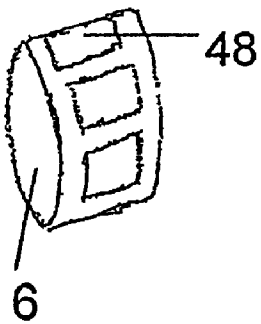
FIG. 6H

INTERFACE SYSTEM FOR GARMENT BARRIER

FIELD OF THE INVENTION

The invention is directed toward a protective article that provides a garment interface which inhibits vapor and liquid ingress through the interface and other associated problems. For example, the invention may be useful for rapid donning and doffing of protective apparel in chemical, hazardous material, or biological events.

BACKGROUND OF THE INVENTION

This invention is directed toward protective garment and particularly focused on the interface between the protective article and the garment. The present invention is the only garment-article interface which allows rapid donning and doffing without assistance and forms a flexible and unencumbering seal. The present invention is effective to inhibit vapor ingress and is comfortable to the wearer.

SUMMARY OF THE INVENTION

The present invention provides a protective sealing system with a barrier seal formed between two articles of apparel comprising at least one elastomeric cuff, each securable to an end of a garment and a sealing support oriented between wearer of garment and at least one elastomeric cuff and in some embodiments a second elastomeric cuff to expand said cuff providing a barrier seal.

An advantage of the present invention is the ease of donning and doffing the garments employing the sealing system. Another advantage is the comfort and lack of pressure on the skin of the wearer at the sealing surfaces of the sealing system. The present invention stabilizes the placement of the cuffs and does not require an outer tape wrap over the cuffs to maintain a barrier seal.

Additional features and advantages of the invention are set forth in the description which follows. To achieve these and other advantages and in accordance with the purpose of the present invention, as embodied and broadly described, the present invention is described as follows:

BRIEF DESCRIPTION OF THE DRAWINGS

FIGS. 6A-H show top and side view schematics of sealing supports of the present invention.

DETAILED DESCRIPTION OF THE INVENTION

Figure 1:
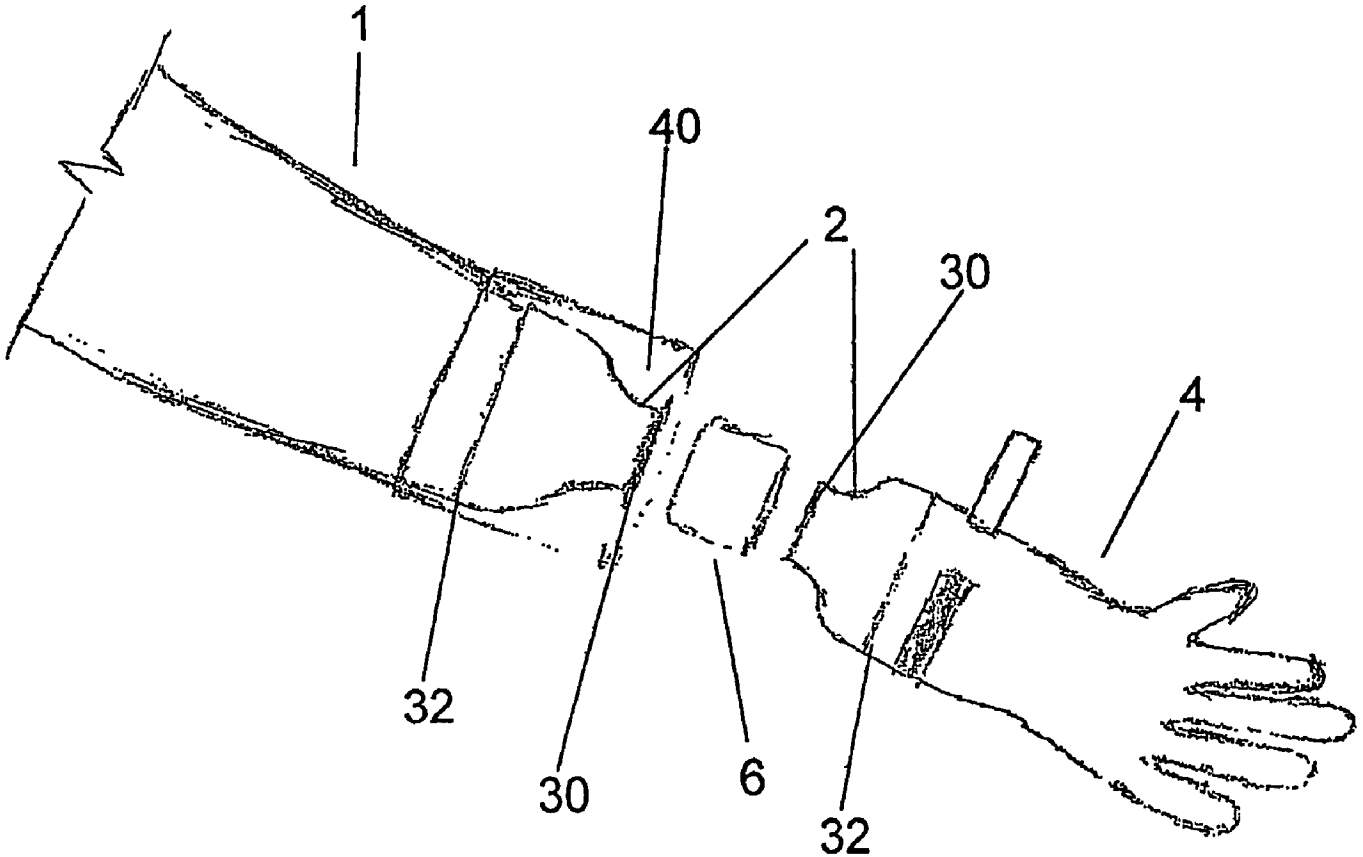
FIG. 1 shows a perspective view of a barrier protective sleeve and mating glove assembly.

The present invention is a protective sealing system providing a barrier seal between two articles of apparel comprising a first elastomeric cuff securable to the end of a garment, such as a sleeve, pant leg, coat, or other garment; a second elastomeric cuff securable to the end of a garment appendage covering; and a sealing support oriented between wearer of garment and both the first elastomeric cuff and the second elastomeric cuff to expand said cuffs providing a barrier seal. The garment appendage covering mates with the garment to form a seal. For instance, the appendage covering in the form of a boot or glove may be mated with a pant leg or sleeve. Similarly head coverings and two piece suits are mated with the present invention to form a barrier seal. The present invention further provides a protective sealing system forming a barrier seal between two articles of apparel comprising at least one elastomeric cuff securable to the end of a garment; a sealing support with a outer diameter sized to expand the elastomeric cuff; and a second cuff joined with the sealing support and oriented between wearer of garment and the elastomeric cuff forming a barrier seal.

By "elastomeric" it is meant to include materials which are capable of ready change or easy expansion or contraction. Types of suitable elastomeric materials include butyl rubbers, natural latex rubbers, butyl neoprene, isoprenes, chloroprenes, polyurethanes, silicones and other suited materials. The elastomeric material may be a "composite" or a material formed from two or more parts. For example, a composite material may be formed of multiple layers of compounds wherein each layer may be joined to another layer via a suitable bonding means. The composite materials of this invention may include one or more textile layers but do not require any textile layer.

The term "cuff" is meant to include the portion of the article meant to form the vapor ingress interface over the sealing support. For instance, the cuff of material may encircle the wrist and may be configured to seal with a second complementary cuff. A cuff may also encircle the foot, ankle, neck, or waist of a wearer.

By "sealing support" it is meant to include a rigid or semi-rigid foundation capable of forming a barrier seal with an elastomeric cuff. The sealing support expands the cuff to at least a minimum circumference required to achieve a barrier seal. A barrier seal for the purposes of this patent is a seal formed between at least one cuff and the sealing support to protect a wearer from vapor ingress of external simulants. The sealing support may be a one-piece support or it may comprise two or more pieces. The sealing support provides a minimum circumference to prevent excessive force on a limb of a wearer. The sealing support allows force to be distributed evenly on a limb and protects the wearer from pressure associated with the sealing interface. In one embodiment the sealing support is a circular sealing support between two and four inches wide with a diameter suited to fit the wearer. For example, on a wrist application, the diameter of the sealing support may be about three inches, whereas for a foot or body sealing support interface, the diameter may be much greater. Further, while the sealing support must form a vapor ingress barrier when assembled with the cuffs, the sealing support may be flexible, rigid, or a combination. The sealing support circumference provides a barrier seal with at least the first elastomeric cuff. A second elastomeric cuff may then overlap at least a portion of the first elastomeric cuff to form a seal with the first elastomeric cuff. It is in this general manner that a vapor preventative interface system is established comprising a single or a double seal.

Figure 2:
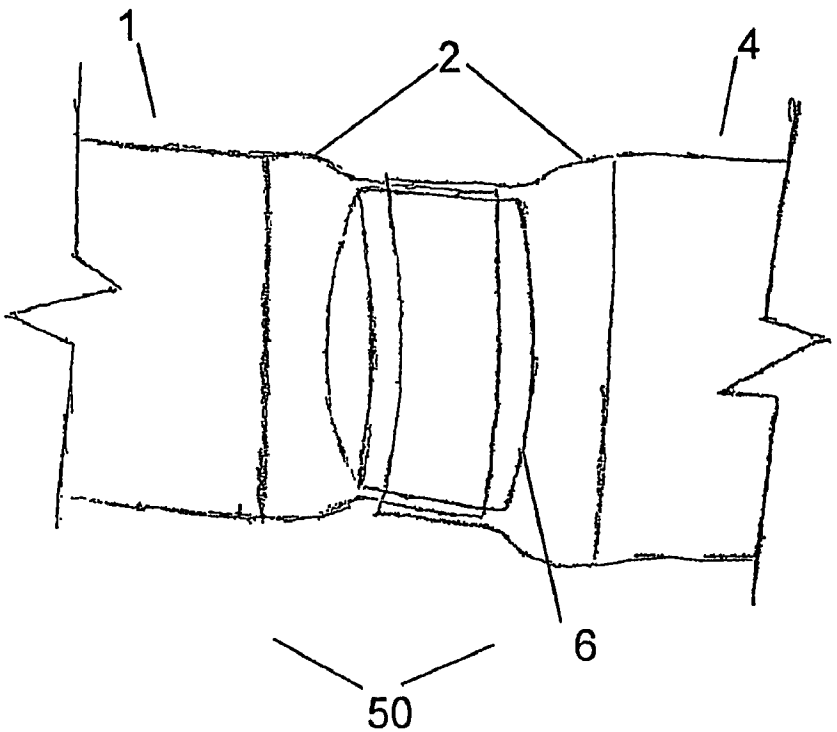
FIG. 2 shows an enlarged perspective view of a glove opening sealed over a sealing support 6, such that the sealing edge 30 of the cuff 2 overlaps so that vapor ingress is prohibited.

FIG. 1 shows the present invention in its most general form. A sleeve 1 is joined to a cuff 2 at the garment edge 32 of the cuff 2. The cuff 2 further comprises a sealing edge which is mated with the sealing support 6 to form a vapor ingress preventative seal. A glove is then sealed over the sealing support 6, such that the sealing edge 30 of the cuff 2 overlaps the sealing support 6. The cuff is adjoined to garment, i.e. a glove in this depiction, so that vapor flow is inhibited to flow into the sealed system 50, as shown formed in FIG. 2.

Figure 3:
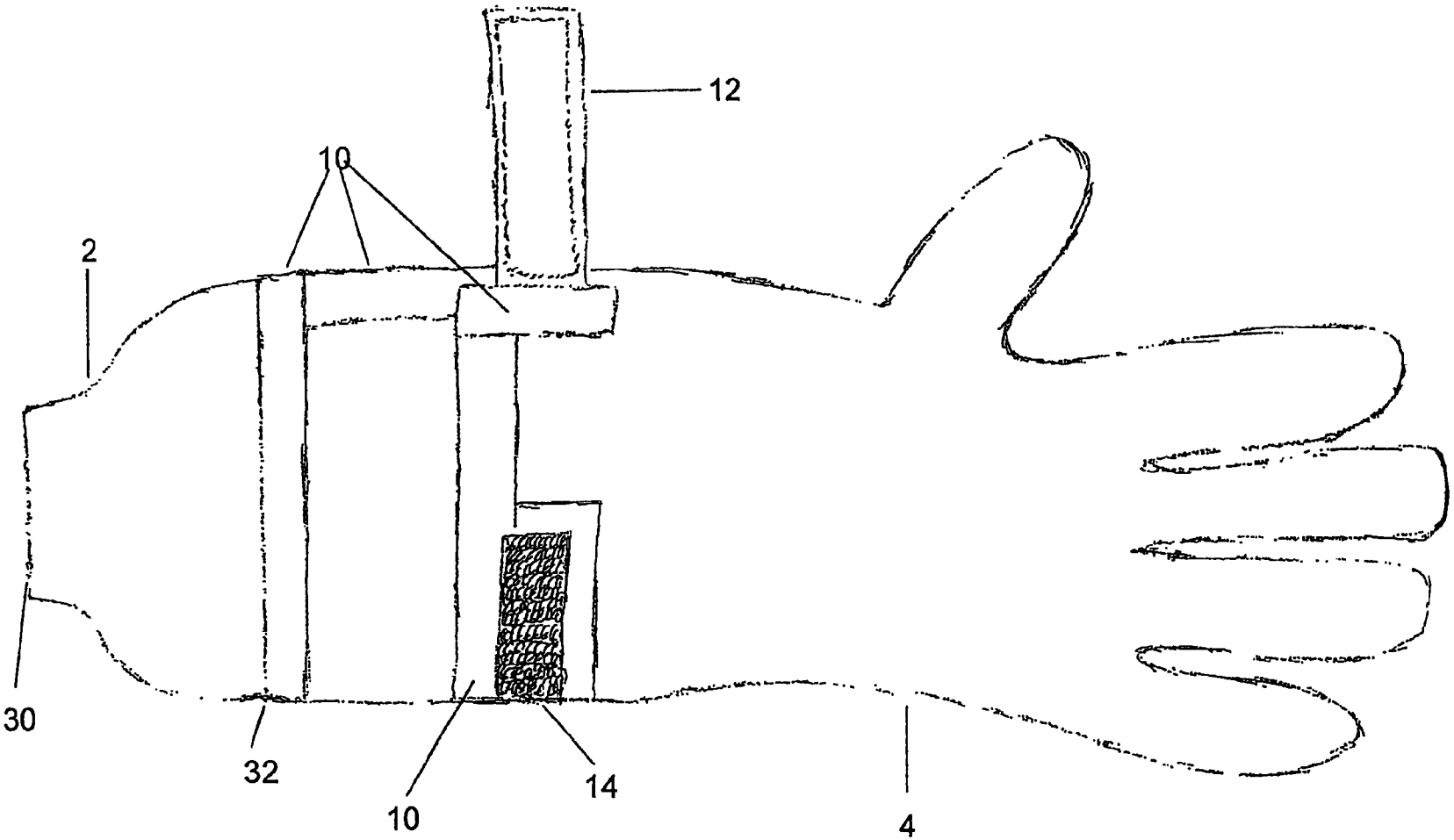
FIG. 3 shows an enlarged top view of a barrier glove with an elastomeric cuff.

FIG. 3 shows one embodiment of the present invention using a glove. The glove 4 is assembled with a securement assembly such as a hook closure 12 and a mating loop closure, or another suitable securement assembly. Contemplated securement assemblies include: snaps, hooks and eyes, ties, clips, and other obvious variations. In this embodiment, a reinforcement 10, such as a seam tape or polymer bead, etc., is used to add strength to the seams and to additionally provide barrier protection to the wearer. An elastomeric cuff 2 is joined to the glove at the garment edge 32 of the cuff 2 and may be fitted with a reinforcement 10 as shown in FIG. 3. The sealing edge 30 of the cuff 2 may be smaller than the garment edge of the cuff 2 to provide a greater circumferential sealing force against the sealing support.

Figure 4A:
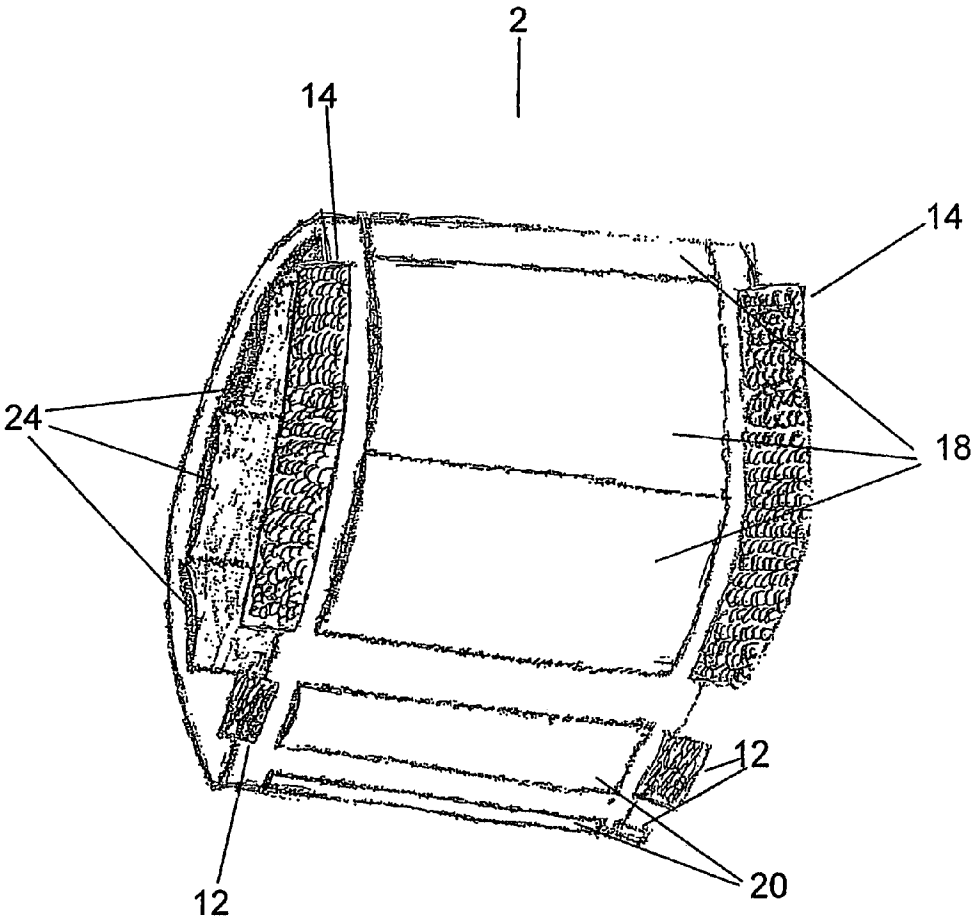
FIG. 4A shows a schematic of an adjustable cuff.
Figure 4B:
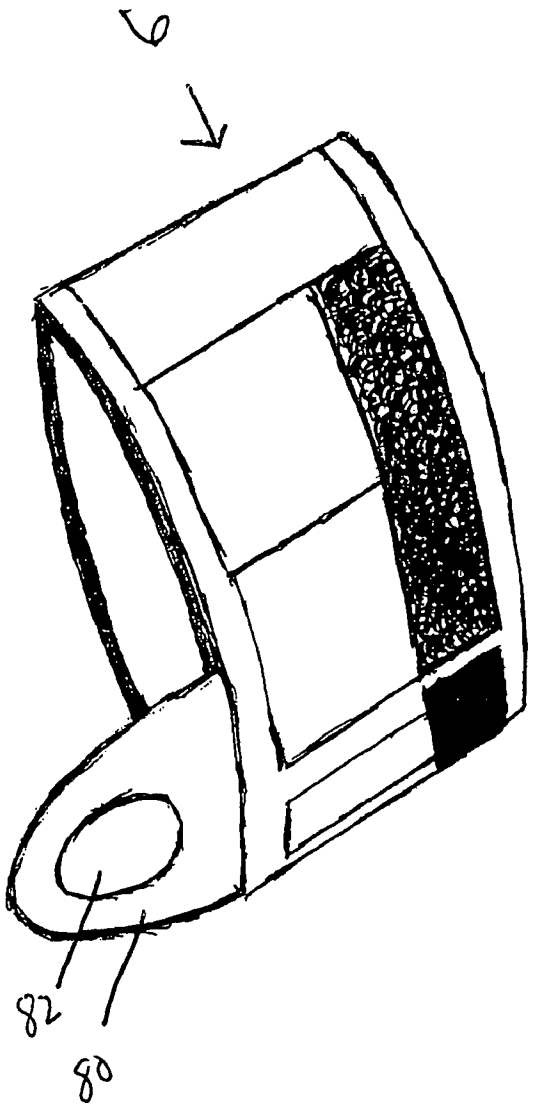
FIG. 4B shows the sealing support with a thumb band for ease of donning and doffing.

FIG. 4A shows an enhanced view of a sealing support 6 of the present invention. In this embodiment, the sealing support 6 comprises pockets for rigid or semi-rigid supports. Multiple closely spaced pockets for semi-rigid supports 18 may be useful around the perimeter of the sealing support 6 to provide large sealing surfaces. Multiple small widely spaced pockets 20 may be used to enclose supports so that a snug fit may be achieved as desired by the wearer. This sealing support 6 embodiment employs a securement assembly, depicted as a hook closure 12 and a mating loop closure 14, to provide ease of donning and comfort of the wearer. A moisture management padding 24 may be present on the interior surface of the sealing support 6 to wick perspiration from the wearer, for added wear comfort. FIG. 4B shows the sealing support with a thumb band 80 for ease of donning and doffing. The thumb band 80 allows the wearer to insert a thumb into the opening 82 and secure the sealing support into position on the wrist. The securement assembly may be present in various positions on the sealing support.

Figure 5B:
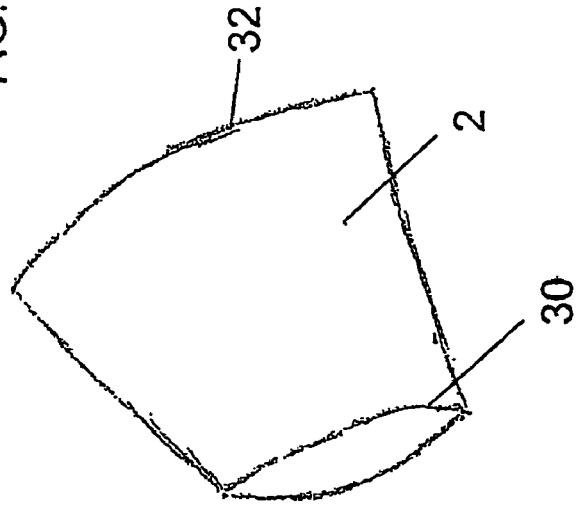
FIGS. 5A-C show schematic views of impermeable cuffs.
Figure 5A:
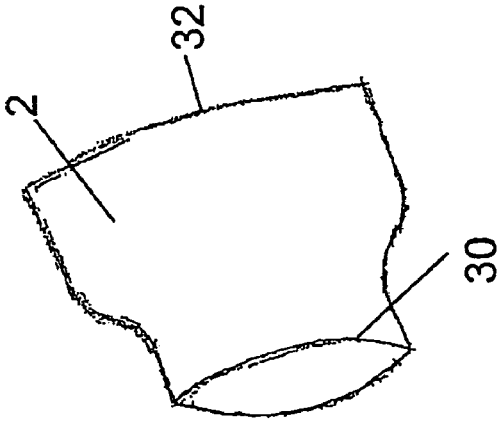
Figure 5C:
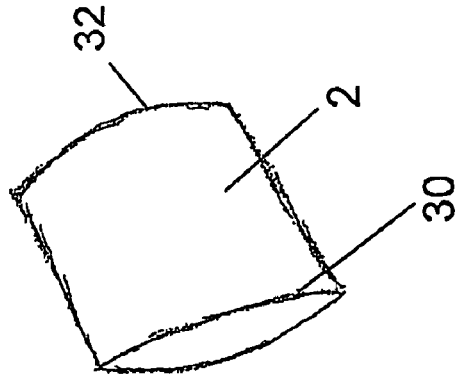

FIGS. 5A-C show some of the multiple variations of sealing support designs contemplated by the present invention. As shown, the cuff may have a sealing edge 30 with a smaller circumference than the circumference of the garment edge 32 as shown in FIGS. 5A-B. The cuff may have a sealing edge 30 and a garment edge 32 with equal circumference measurements, as shown in FIG. 5C. Optionally, the cuff 2 may be designed to have a sealing edge 30 with a larger circumference than the circumference of the garment edge 32 which may be advantageous for embodiments other than gloves, for example boots and waistbands. The depictions of FIGS. 6A-H show top and side views of additional various sealing supports contemplated by the present invention. The sealing support 6 may comprise a circular perimeter, as shown in FIGS. 6A-C. It may thus be desirable to employ a hinged joint 31 to allow for rapid donning and doffing of the sealing support 6. As shown in FIGS. 6D-F, the sealing support may comprise multiple interlocking pieces. The interlocking pieces may be engineered to form circular or non-circular perimeters as desired. FIG. 6G depicts an adjustable sealing support 6 which comprises pockets for rigid or semi-rigid supports. Multiple closely spaced pockets for semi-rigid supports 18 may be useful around the perimeter of the sealing support 6 to provide large sealing surfaces. Multiple small widely spaced pockets 20 may be used to enclose supports so that a snug fit may be achieved as desired by the wearer. A securement assembly, depicted as a hook closure 12 and a mating loop closure 14, provides ease of donning and increased wearer comfort. FIG. 6H shows a sealing support 6 with multiple open areas 48 which provide increased sealing edge areas on the sealing support.

Figure 7:
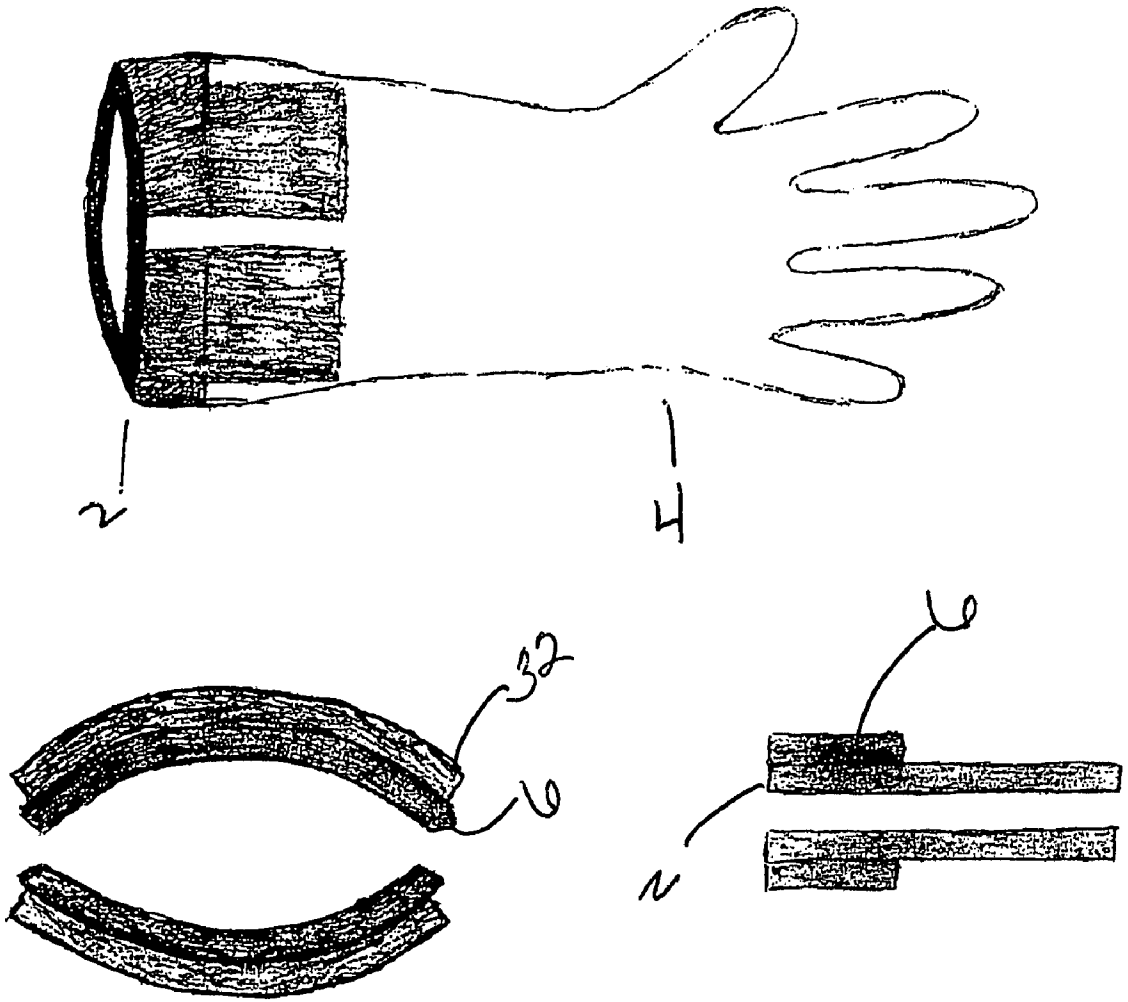
FIG. 7A shows a perspective view of combined seal support and gloves.
FIG. 7B shows a cross-sectional view of sealing support joined with a glove gauntlet.
FIG. 7C shows a side view of the sealing support joined with a glove gauntlet.

FIG. 7A-C show other embodiments of the present invention. In FIGS. 7A and 7B the sealing support may be joined to a protective garment, such as a glove, boot, or neckband. In this embodiment, the sealing support 6 aids in a faster donning and doffing of the garment, by reducing the number of parts necessary for the wearer to handle. FIG. 7A shows a perspective view of a combined sealing support 6 and glove 4. The sealing support 6 is joined to a cuff 2 at the garment edge 32 of the cuff 2. The cuff 2 is then mated with a protective garment edge 32 to form a vapor ingress preventative seal. In this manner, the glove 4 is then sealed over the sealing support 6, such that the sealing edge 30 of the cuff 2 overlaps the sealing support 6, the glove is placed into a mating sleeve of a protective garment so that vapor flow is inhibited from flowing into the sealed system. FIG. 7B shows a cross-sectional view of sealing support 6 joined with a garment edge 32 of a cuff. FIG. 7C shows a side view variation of this embodiment in which the sealing support is joined on the outside of the cuff of a protective garment. In this embodiment, a mating sleeve may be positioned over the sealing support 6 to form a seal. The mating sleeve may additionally form an interlocking connection with the sealing support to physically interlock and strengthen the seal.

The following non-limiting examples are provided to further illustrate the present invention.

EXAMPLES

Example 1

A glove constructed with an impermeable barrier liner, available from W. L. Gore & Associates Inc., Elkton, Md., item number G9492-C2 with GORE™ CHEMPAK® Ultra Barrier, was attached to an elastic butyl rubber cuff, available from Formco, Canton, Ohio, item number FWS32, as shown in FIG. 3.

The top of the glove was tapered to match the dimensions of the larger end of the elastic butyl rubber cuff. The rubber cuff was sewn to the glove. The seam between the glove and the rubber cuff was brushed with rubber adhesive, available from 3M, St. Paul, Minn., item number 62-1300-5530-4, was brushed on the seam. The two seams up the side of the glove as well as the seam between the glove and the rubber cuff were sealed with impermeable seam tape, available from W. L. Gore & Associates Inc., Elkton, Md., item number 6H2AJO22BLKNM, on the exterior of the glove. One-inch hook and loop connector straps, from Norman Shatz Company, Bensalem, Pa., were sewn to the impermeable seam tape and then adhered to the glove in the locations seen in FIG. 3.

A garment constructed from an impermeable barrier, available from Lion Apparel, Dayton, Ohio, item Number MT-94 with GORE™ CHEMPAK® Ultra Barrier, was used in conjunction with the glove described in FIG. 1.

The garment was donned by the wearer and the glove was donned next. The elastic cuff of the glove was pulled over the elastic cuff of the sleeve. In this example, no sealing support was used, so the wearer had to allow the air from the glove to escape ("burping" the glove).

The strap portion of the glove cuff was then pulled over the elastic cuffs and cinched tight (in this case, with hook and loop fastener). [Note: This step is performed to allow for snug fit and to prevent disturbance of seal in case glove is pulled forward inadvertently.]

The Man-in-Simulant Test (MIST) from NFPA 1994 2006 Edition [8.66] for vapor ingress was then performed. The wearer performed exercises while exposed to a simulant. Chemically absorbent patches are placed on the body to test location and quantity of simulant passing through the suit or interfaces.

Results are reported as Protection Factor:

$$PF=[\{\text{Concentration}\times\text{Time}\}\text{Out}]/[\{\text{Concentration}\times\text{Time}\}\text{In}]$$

The PF for the Ensemble described in Example 1A:

Absorbent Patch—Hand: 2,239 average

Absorbent Patch—Forearm: 2,066 average

This performance is well in excess of the 360 minimum described in the NFPA standard and greater than or equal to "best-in-class" competitive systems.

The Overall Liquid Integrity Test 1 from NFPA 1971 2006 Edition [8.33] was then performed. The glove and interface are submerged in water where the surface tension has been lowered to 35 dynes/cm±5 dynes/cm with a surfactant. The glove and interface are flexed every ten seconds for five minutes. Any leakage through the glove or interface constitutes a failure.

This configuration passed this test with no observable liquid water leakage.

Example 2

The glove and garment as described in Example 1 were used. A three-inch wide circular sealing support as shown in FIG. 6A-C, with a three-inch diameter was put underneath the overlapping elastic cuffs.

This configuration passed the Overall Glove Integrity Test with no observable liquid water leakage.

Example 3

The glove and garment as described in Example 1 were used. A three-inch wide adjustable sealing support, as described in FIGS. 4, 4B, 6B, and 6H, was put underneath the overlapping elastic cuffs.

This configuration passed the Overall Glove Integrity Test with no observable liquid water leakage.

Example 4

The garment as described in Example 1 was used. A glove as described in Example 1 with no elastic cuff was substituted to demonstrate the improvement with the current invention.

Results from the Man-in-Simulant Test are reported as Protection Factor:

Absorbent Patch—Hand: 692 average

Absorbent Patch—Forearm: 385 average

This performance is in excess of the 360 minimum described in the NFPA standard. However, it does not compare to "best-in-class" competitive systems. Additionally, the wearer felt pressure from the interface site against the body.

This configuration did not pass the Overall Glove Integrity Test.

Example 5

The garment as described in Example 1 was used. A glove as described in Example 1 with a sheet of thermoplastic polyurethane bonded to the cuff laminate and without an elastic cuff was used. Approximately three inches of the cuff laminate nearest the wrist were covered by the polyurethane.

Results from the Man-in-Simulant Test are reported as Protection Factor:

Absorbent Patch—Hand: 2,585 average

Absorbent Patch—Forearm: 762 average

This performance is in excess of the 360 minimum described in the NFPA standard and in excess of the system described in Example 4.

This configuration did not pass the Overall Glove Integrity Test.

Example 6

The garment as described in Example 1 was used. A glove as described in Example 1 without the elastic cuff was used. A glove seal interface ring system, available from Dupont, Wilmington, Del., item number 990140, was used to seal the glove to the garment. This ring system is used commercially but does not have the advantages offered by this invention such as rapid donning/doffing and semi-rigid, unencumbering sealing interface. The results from the Man-in-Simulant Test are reported as Protection Factor:

Absorbent Patch—Hand: 1,875 average

Absorbent Patch—Forearm: 2,092 average

This configuration did not pass the Overall Glove Integrity Test.

We claim:

1. A protective sealing system providing a barrier seal between two articles of apparel comprising:

a. a first elastomeric cuff securable to the end of a garment, b. a second elastomeric cuff securable to the end of a garment appendage covering; and c. a continuous flexible sealing support oriented to contact wearer of garment and further oriented between wearer of garment and both the first elastomeric cuff and the second elastomeric cuff to expand said cuffs providing a barrier seal wherein the elastomeric cuffs are immediately adjacent to each other and form a liquid proof seal, wherein the sealing support comprises pockets for rigid or semi-rigid supports.

2. The system of claim 1 wherein the sealing support is one piece.

3. The system of claim 1 wherein the sealing support is two pieces.

4. The system of claim 1 wherein the sealing support is flexible.

5. The system of claim 1 wherein the sealing support is rigid.

6. The system of claim 1 wherein the sealing support circumference provides a barrier seal with at least the first elastomeric cuff.

7. The system of claim 1 wherein the second elastomeric cuff overlaps at least a portion of the first elastomeric cuff.

8. The system of claim 1 wherein the sealing support is one piece.

9. The system of claim 1 wherein the sealing support is two pieces.

10. The system of claim 1 wherein the sealing support is flexible.

11. The system of claim 1 wherein the sealing support is rigid.

12. The system of claim 1 wherein the sealing support circumference provides a barrier seal with at least the first elastomeric cuff.

13. The system of claim 1 wherein the second elastomeric cuff overlaps at least a portion of the first elastomeric cuff.

14. The system of claim 1, wherein the sealing support comprises moisture management padding on an interior surface of the sealing support for wicking perspiration from a wearer.

15. The system of claim 1 wherein the sealing support comprises a thumb band for securing the sealing support into position on a wrist.

16. The system of claim 1, wherein the sealing support comprises multiple open areas.

17. A protective sealing system providing a barrier seal between two articles of apparel comprising:

a. an elastomeric cuff securable to the end of a garment;

b. a sealing support oriented to contact wearer of garment and having an outer diameter sized to expand the elastomeric cuff; and c. a second cuff joined with the sealing support and oriented between wearer of garment and the elastomeric cuff forming a barrier seal, wherein the sealing support comprises pockets for rigid or semi-rigid supports.

18. A protective sealing system providing a barrier seal between two articles of apparel comprising:

a. a first elastomeric cuff securable to the end of a garment, b. a second elastomeric cuff securable to the end of a garment appendage covering; and c. a continuous conical sealing support oriented to contact wearer of garment and further oriented between wearer of garment and both the first elastomeric cuff and the second elastomeric cuff to expand said cuffs providing a barrier seal wherein the elastomeric cuffs are immediately adjacent to each other and form a liquid proof seal, wherein the sealing support comprises pockets for rigid or semi-rigid supports.

19. A protective sealing system providing a barrier seal between two articles of apparel comprising:

a. a first elastomeric cuff securable to the end of a garment, b. a second elastomeric cuff securable to the end of a garment appendage covering; and c. a one-piece sealing support oriented to contact wearer of garment and further oriented between wearer of garment and both the first elastomeric cuff and the second elastomeric cuff to expand said cuffs providing a barrier seal wherein the elastomeric cuffs are immediately adjacent to each other and form a liquid proof seal, wherein the sealing support comprises pockets for rigid or semi-rigid supports.

20. A protective sealing system providing a barrier seal between two articles of apparel comprising:

a. an elastomeric cuff securable to the end of a garment;

b. a sealing support oriented to contact wearer of garment and having an outer diameter sized to expand the elastomeric cuff; and c. a second cuff joined with the sealing support and oriented between wearer of garment and the elastomeric cuff forming a barrier seal wherein the elastomeric cuffs are immediately adjacent to each other and form a liquid proof seal, wherein the sealing support comprises pockets for rigid or semi-rigid supports.

* * * * *